United States Patent [19]

Maletic

[11] Patent Number: 4,743,140

[45] Date of Patent: May 10, 1988

[54] TEXTURING DEVICE FOR WET CONCRETE

[76] Inventor: Victor A. Maletic, 3330 Meadowbrook Rd., Antioch, Calif. 94509

[21] Appl. No.: 751,554

[22] Filed: Jul. 3, 1985

[51] Int. Cl.[4] ..... E01C 23/02

[52] U.S. Cl. ..... 404/89; 404/93; 425/385

[58] Field of Search ..... 425/385, 63, 87, 62, 425/112, 336; 404/89, 93; 264/284, 293; 172/376, 381, 532, 537, 611, 771; 56/400.01, 400.02, 400.19, 400.21

[56] References Cited

U.S. PATENT DOCUMENTS

| | | | |
|---|---|---|---|
| 637,190 | 11/1899 | Whipple | 404/118 X |
| 936,712 | 10/1909 | Griffin | 172/532 |
| 1,100,323 | 6/1914 | Ovens | 56/400.21 X |
| 1,743,151 | 1/1930 | Malepsy | 172/532 |
| 2,033,451 | 3/1936 | Rose | 56/400.19 |
| 2,036,807 | 4/1936 | Honn | 56/400.01 |
| 2,468,376 | 4/1949 | Peeples | 56/400.17 X |
| 2,808,771 | 10/1957 | Brown | 172/532 |
| 3,605,579 | 9/1971 | Heltzel | 404/93 |
| 3,703,857 | 11/1972 | MacKinnon | 404/93 |
| 3,775,018 | 11/1973 | Barton | 404/93 |
| 3,801,211 | 4/1974 | Perkins | 404/89 |
| 3,874,806 | 4/1975 | Grist et al. | 404/93 |
| 3,936,209 | 2/1976 | Krage | 404/118 X |
| 4,318,631 | 3/1982 | Vickers | 404/93 |

FOREIGN PATENT DOCUMENTS

| | | | |
|---|---|---|---|
| 1124074 | 2/1962 | Fed. Rep. of Germany | 404/93 |
| 2151385 | 1/1983 | Fed. Rep. of Germany | 404/89 |
| 1580283 | 9/1969 | France | 404/93 |
| 8201287 | 10/1983 | Netherlands | 404/89 |
| 2030034 | 4/1980 | United Kingdom | 56/400.01 |
| 2093672 | 9/1982 | United Kingdom | 56/400.01 |

*Primary Examiner*—Jay H. Woo
*Assistant Examiner*—James C. Housel
*Attorney, Agent, or Firm*—Bielen and Peterson

[57] ABSTRACT

A device for texturing surface of freshly poured concrete utilizing a platform having first and second surfaces. A plurality of loops are spaced along and extend from the first surface of the platform. The plurality of loops are connected to the platform for movement with the platform.

10 Claims, 2 Drawing Sheets

TEXTURING DEVICE FOR WET CONCRETE

BACKGROUND OF THE INVENTION

The present invention relates to a novel device for texturing the surface of freshly poured concrete.

Concrete employed for roadwaysand bridges require texturing such that a multiplicity of grooves or striations are formed on the surface of the concrete intended for frictionally contacting vehicles tires. Governmental authorities require vehicular concrete surfaces to meet a certain coefficient of friction test. Initially freshly poured concrete may often meet the coefficient or friction test without texturing. However, after a number of years a vehicular concrete surface may become smooth and fail the same test. Therefore, it is important to texture freshly concrete to insure that a vehicular roadway will possess a requisite degree of roughness over long periods of time e.g. 30 to 50 years.

In the past, mats or sacks of fibrous material have been dragged over freshly poured concrete in this regard. However, an inconsistent textured surface often results and these materials lack durability. Brooms have often been employed for the same purpose but tend to produce a surface texture that is too coarse. In addition, broom tend to pull aggregate from the freshly poured concrete and scatter the same over the surface of the concrete. Brooming also requires the provision of walkways for the persons using the same which is quite expensive and time consuming. Tining forks may also be pulled across fresly poured concrete but, again, aggregate is dislodged and a very rough surface results.

Complicating the process of texturing is the fact that freshly poured concrete differs in consistency as a result of the manufacturing process, moisture content of the components and the weather conditions existing during the pouring of the concrete. Modern paving techniques call for the use of paving carriage finishers which automatically pour and strike the concrete. Texturing should be incorporated into the use of carriage finishers to increase the efficiency of paving work.

A texturing device that solves the problems noted in the prior art will be a great advance in the art of surface paving.

SUMMARY OF THE INVENTION

In accordance with the present invention a novel and useful device for texturing of the surface of freshly poured concrete is provided.

The device of the present invention employs a platform which has a first surface and a second surface. The platform may be formed of any rigid or semi-rigid material. A plurality of loops are also used and are connected to the platform and spaced from the first surface of the platform. The loops are connected to the platform so that the loops and the platform generally move together over the surface of the concrete.

The plurality of loops may include a single or double helical member which extends along the surface of the platform. The helical member may be constructed to possess flexibility along its axis. In addition, the helical member or members may pivot about the connection means along the line of travel of texturing device.

The connecting means may include a rod which fixes to the platform and extends through the helical member or members. Thus, the helical member may move transversely to the direction of travel of the texturing device. Moreover, the resiliency possessed by the helical member or members permits movement or deformation throughout a plane which is perpendicular to the direction of travel of the texturing device. Finally, there may be movement between successive loops of the helical member or members. The rod holding the helical member to the platform may be provided with stops to restrict relative movement between the helical member or members between the platform along the line of the travel of the texturing device.

The platform may be constructed also to hold a mass of material on the second surface to exert a normal force on the helical member or members below. For example concrete may be placed on the second surface of the platform.

The texturing device of the present invention may include means for linking the same to a kinetic source i.e. a carriage finisher. Thus, a texturing device hereindescribed may be directly connected to the carriage finisher such that texturing takes place immediately after striking of the concrete.

It may be apparent that a novel and useful concrete texturing device has been described.

It is therefore an object of the present invention to provide a device for texturing the surface of freshly poured concrete which is compatible with carriage finishing machines.

Another object of the present invention is to provide a device for texturing the surface of freshly poured concrete which is compatible with aggregate used in the concrete in that aggregate is not dislodged and carried across the surface of the concrete at any time during the texturing process.

It is yet another object of the present invention to provide a device for texturing the surface of freshly poured concrete which is usable with concrete in various stages of softness and hardness.

A further object of the present invention is to provide a device for texturing the surface of freshly poured concrete which is compatible with various types of concrete including air entrained concrete, steel fiber reinforced concrete, and the like.

Yet another object of the present invention is to provide a device for texturing the surface of freshly poured concrete which is economical to manufacture and efficiently performs the texturing task.

The invention possesses other objects and advantages especially as concerns particular characteristics and features thereof which will be apparent as the specification continues.

Figure 1:
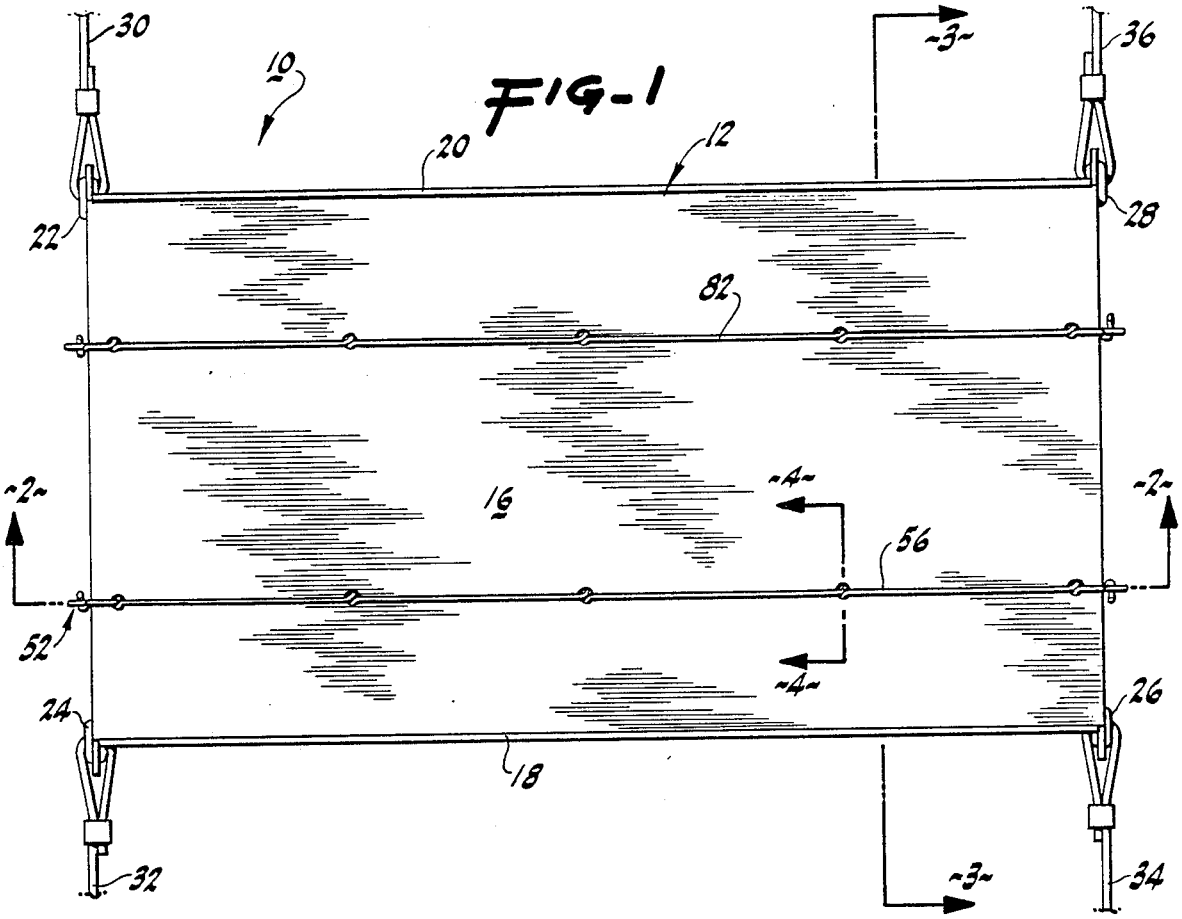
FIG. 1 is a top plan view of the texturing device of the present invention.

For a better understanding of the invention reference is made to the heretofore description of the preferred embodiments thereof which should be referenced to the hereinabove drawings.

DESCRIPTION OF THE PREFERRED EMBODIMENTS

Various aspects of the present invention will evolve from the following detailed description of the preferred embodiments which will be referenced to the hereinabove drawings.

The invention as a whole is designated in the drawings by reference character 10. The concrete texturing device 10 includes as one of its elements a platform 12 having a first lower surface 14 and a second upper surface 16. Shoulders 18 and 20 extend upwardly from surface 16 along two sides of platform 12. Although platform 12 is shown as being rectangular in plan view and planar, it should be understood that platform 12 may take other shapes such as circular in plan view, cupshaped, and the like. Grommets 22, 24, 26 and 28 serve as anchoring points for lines 30,32,34, and 36, the purpose of which will be described hereinafter.

Figure 2:
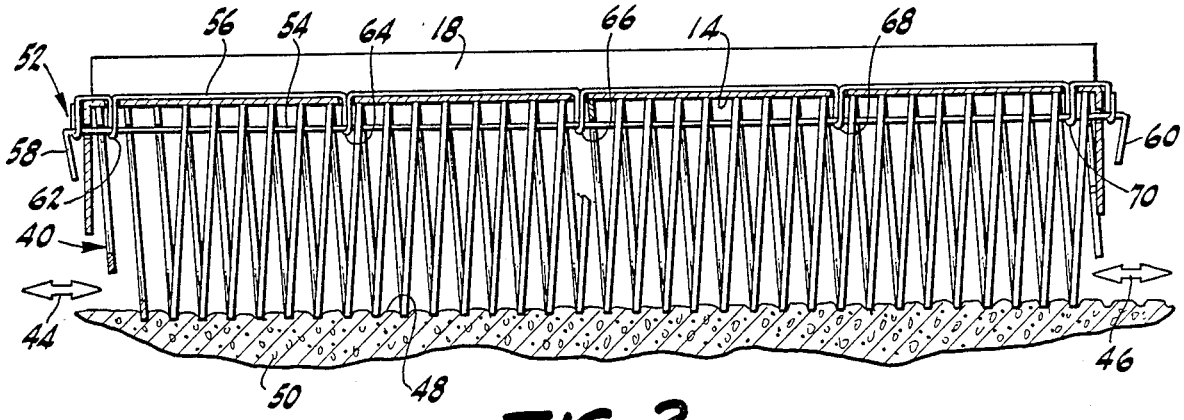
FIG. 2 is a sectional view taken along line 2—2 of FIG. 1 showing a portion of a concrete surface being textured.

Turning to FIG. 2 it may be seen that a plurality of loops are spaced along and extend outwardly from first surface 14 of platform. As depicted in the preferred embodiments in the drawings. Plurality of loops 38 may take the form of helical members 40 and 42, best shown in FIGS. 2, 3, and 6. With reference to FIG. 2 it may be seen that helical member 40 is illustrated and is substantially identical to adjoining or adjacent helical member 42. Helical member 40 possesses the properties of a coil spring. Member 40 may be constructed of any material exhibiting these properties and is preferably formed of PVC (polyvinylchloride) plastic. Thus, there is flexibility between successive coils between helical member 40 according to directional arrows 44 and 46. In other words, the coils or loops of helical member 40 move along axis 46 of helical member 40. This axial movement is especially acute at the point of contact between the coils of helical member 40 and the surface 48 of soft concrete pour 50.

Means 52 connects plurality of loops 38 to platform 12. Means 52 externalizes in the embodiment shown as a rod 54 which extends along first surface 14 of platform 12 in spaced relationship therewith. Rod 54 is held in position by wire 56 which wraps around the end portion 58 and 60 of rod 54 and encircles rod 54 along its span beneath first surface 14 of platform 14. These encirclements 62 64, 66, 68, and 70 also forms stops in the travel of helical member 40.

Figure 4:
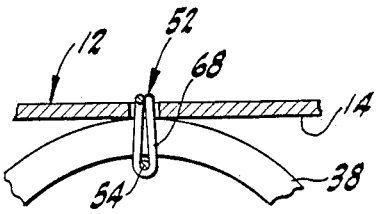
FIG. 4 is an enlarged partial sectional view taken generally along line 4—4 of FIG. 1.
Figure 5:
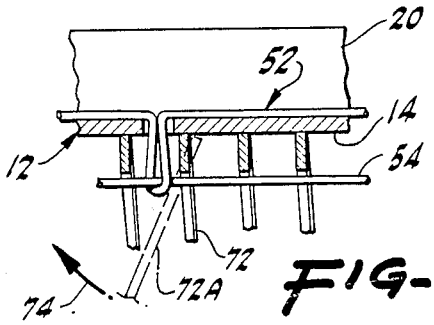
FIG. 5 is an enlarged sectional view of the upper portion of FIG. 2.

Turning to FIGS. 4 and 5, encirclement 68 is depicted. FIG. 5 illustrates the pivoting of a loop 72 such as loop 72A when stop or encirclement 68 is contacted by the upper portion of loop 72. Thus, plurality of loops 38 also pivot relative to through rod 54 and perpendicular to platform 12, directional arrow 74.

Figure 3:
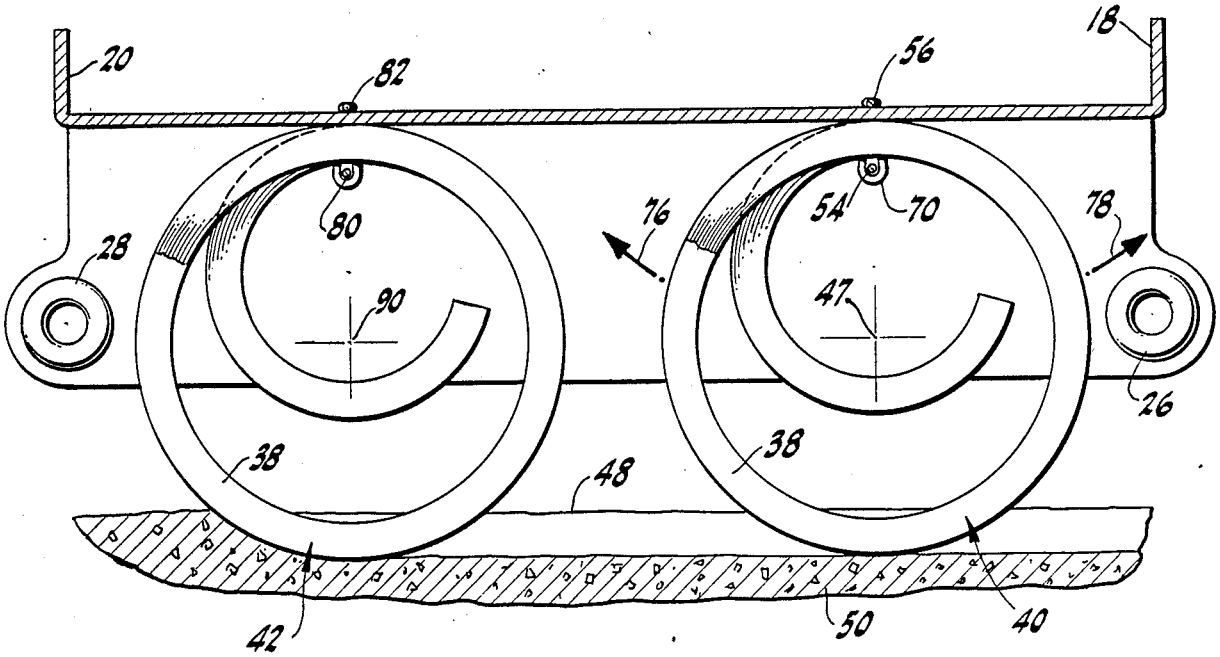
FIG. 3 is a sectional view taken along line 3—3 of FIG. 1.

Turning to FIG. 3 it may be seen that helical member 40 is able to pivot according to directional arrows 76 and 78 i.e. in planes that are perpendicular to rod 54. Of course, above description in reference to helical member 40 also applies to helical member 42 which includes a rod 80 and wire 82. The connection of the helical member 42 to platform 12 is identical to that of helical member 40 and no further details will be given therewith for the sake of clarity.

Figure 6:
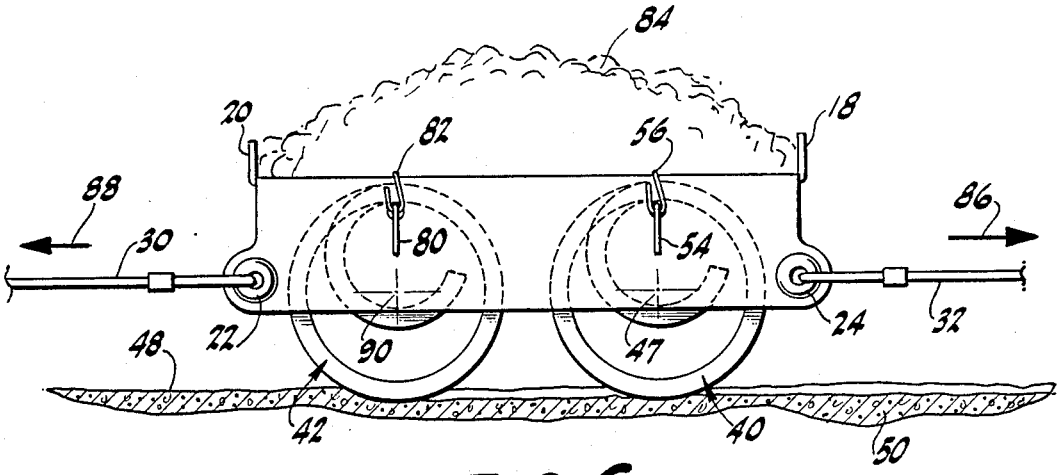
FIG. 6 is an end view of the device being moved across a soft concrete surfaces.

The texturing device 12 is also provided with means for confining a selected mass of material such as concrete mass 84, FIG. 6, to second surface 16 of platform 12. Of course, other objects having mass may be used in place of concrete mass 84.

In operation, the user connects lines 30, 32, 34, and 36 to the kinetic source (not shown) which would drag device 10 across surface 48 of concrete pour 50 according to directional arrows 86 and 88, FIG. 6. Plurality of loops 38 in the form of helical members 40 and 42 will score or groove the surface 48 of concrete pour 50, best shown in FIG. 2. In addition, to the resilient or flexible characteristics of helical members 40 or 42, heretofore described, helical members will compress or expand along axes 46 and 90. The ability to give when a force is applied to plurality of loops 38 renders device 10 compatible with any concrete materials, especially those having large objects such as aggregate, metal fibre, and the like. Device 10 may be connected to a carriage finisher and thus be dragged back and forth over pour 50 immediately after striking off the concrete. Any variation in the softness or hardness of the concrete pour 50 may be compensated for by placing a mass such as concrete mass 84 on the second surface 14 of platform 12 to of lesser or greater weight.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A device for texturing the surface of freshly poured concrete used in conjuction with a kinetic source comprising:

a. a platform having a first surface and a second surface;

b. a plurality of closed loops spaced along and extending outwardly from said platform first surface, each of said closed loops possessing flexibility transversely in multiple directions relative to the freshly poured concrete;

c. means for connecting said plurality of closed loops to said platform, to permit limited transverse movement of each closed loop relative to the adjacent closed loop, said connecting means including a connecting rod engaging the internal periphery of each closed loop adjacent said first surface of said platform to permit rotation of each closed loop immediately about said rod.

2. The device of claim 1 in which said plurality of loops includes a helical member having a portion which drags on the freshly poured concrete.

3. The device of claim 2 in which said helical member extends along said first surface of said platform, said helical member being resilient along an axis thereof, and said means for connecting said plurality of loops to said platform comprises means for connecting said helical member to said platform.

4. The device of claim 3 in which said means for connecting said helical member to said platform includes said connecting rod which is supported by and extends along said platform and pivotally holds said helical member thereto.

5. The device of claim 4 in which said connecting rod extends through at least a portion of said helical member and said helical member being movable along said rod.

6. The device of claim 5 in which said connecting rod includes stop means for restricting said movement of said helical member along said rod.

7. The device of claim 1 in which said platform second surface includes means for confining a selected mass of material on said second surface of said platform.

8. The device of claim 1 which further comprises means for linking said platform to the kinetic source.

9. The device of claim 2 in which said helical member is a first helical member and said plurality of loops additionally comprises a second helical member, and said means for connecting said plurality of loops to said platform comprises means for connecting said second helical member to said platform adjacent said first helical member.

10. The device of claim 9 in which said means for connecting said second helical member to said platform includes a rod which is supported by and extends along said platform, said rod pivotally holding said second helical member to said platform, said rod extending through at least a portion of said second helical member and said second helical member being movable along said rod.

* * * * *